US007617887B2

(12) United States Patent
Piipponen

(10) Patent No.: US 7,617,887 B2
(45) Date of Patent: Nov. 17, 2009

(54) METHOD FOR CASING DRILLING, DRILLING UNIT AND ADAPTER DEVICE

(75) Inventor: Juha Piipponen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 134 days.

(21) Appl. No.: 11/792,362

(22) PCT Filed: Dec. 5, 2005

(86) PCT No.: PCT/FI2005/050446

§ 371 (c)(1),
(2), (4) Date: Aug. 21, 2007

(87) PCT Pub. No.: WO2006/061459

PCT Pub. Date: Jun. 15, 2006

(65) Prior Publication Data

US 2008/0011516 A1 Jan. 17, 2008

(30) Foreign Application Priority Data

Dec. 7, 2004 (FI) ..... 20045467

(51) Int. Cl.
*E21B 3/00* (2006.01)

(52) U.S. Cl. ..... 175/57; 173/1; 173/184; 175/203

(58) Field of Classification Search ..... 175/203
See application file for complete search history.

(56) References Cited

U.S. PATENT DOCUMENTS

| | | | | |
|---|---|---|---|---|
| 3,231,032 | A * | 1/1966 | Genberg et al. | 175/171 |
| 3,835,943 | A * | 9/1974 | Bray | 175/135 |
| 4,582,146 | A | 4/1986 | Becker | |
| 5,263,545 | A | 11/1993 | Tudora et al. | |

FOREIGN PATENT DOCUMENTS

| | | |
|---|---|---|
| EP | 0 565 502 | 10/1993 |
| EP | 0 685 630 | 12/1995 |
| JP | 4-34193 | 2/1992 |
| WO | 91/04391 | 4/1991 |

OTHER PUBLICATIONS

International Search Report dated Mar. 21, 2006 in PCT Application No. PCT/FI2005/050446.
Finnish Office Action dated Nov. 7, 2005 issue in Finland Application No. 20045467.

* cited by examiner

*Primary Examiner*—David J Bagnell
*Assistant Examiner*—Catherine Loikith
(74) *Attorney, Agent, or Firm*—Drinker, Biddle & Reath LLP

(57) ABSTRACT

A method for casing drilling, a drilling unit and an adapter device. The adapter device to be used in extension drill equipment drilling comprises an inner piece which can be rotated by the rotation device of the rock drilling machine. Around the inner piece, there is an outer piece which can be moved in the axial direction with respect to the inner piece. By changing the axial position of the outer piece, it can be selected whether the rotation force is directed from the rotation device to the inner rod or to the outer tube used in casing drilling during threading.

12 Claims, 4 Drawing Sheets

METHOD FOR CASING DRILLING, DRILLING UNIT AND ADAPTER DEVICE

BACKGROUND OF THE INVENTION

The invention relates to a method for casing drilling, the method comprising: drilling rock by rotating an inner rod by a rotation device included in a rock drilling machine, and breaking rock by at least one drill bit and pulling an outer tube into a borehole during drilling; forming extension drill equipment by joining two or more inner rods one after another in the longitudinal direction and by correspondingly joining two or more outer tubes one after another in the longitudinal direction; turning the inner rod about its longitudinal axis when the inner rods are joined together or when the extension drill equipment is disassembled; turning the outer tube about its longitudinal axis when the outer tubes are joined together or when the extension drill equipment is disassembled; performing the turning needed to join the inner rods and the outer tubes non-simultaneously; performing the rotation of the inner rod and the outer tube by means of the rotation device of the rock drilling machine and an adapter device connected thereto when the extension drill equipment is being assembled or disassembled.

The invention further relates to a drilling unit comprising: a rock drilling machine including at least one rotation device for rotating at least one inner rod about its longitudinal axis; a feed mechanism for moving the rock drilling machine; and a feed beam which supports the rock drilling machine and on which the rock drilling machine is moved forward towards the rock to be drilled and backwards; and an adapter device arranged to transmit the rotation force generated by the rotation device of the rock drilling machine to the inner rod; the adapter device comprising an elongated inner piece whose first end receives the rotation force generated by the rotation device and whose second end is connectable to the inner rod; the adapter device further comprising an outer piece, which is an elongated tubular piece, which is arranged at least partly around the inner piece and whose second end is connectable to the outer tube used in casing drilling.

The invention further relates to an adapter device for transmitting rotation force from a rotation device of a rock drilling machine to at least one tool, the adapter device comprising: an elongated inner piece having a first end and a second end; the first end of the inner piece comprising first means enabling transmission of rotation force from the rotation device of the rock drilling machine to the inner piece and the second end of the inner piece comprising second joining means enabling connecting the inner piece to the inner rod; an outer piece, which is an elongated tubular piece having a first end and a second end and which is arranged at least partly around the inner piece; the second end of the outer piece comprising third joining means enabling connecting the outer piece to an outer tube used in casing drilling.

When a tunnel is excavated in broken or soft rock or in a rock having an otherwise poor quality for excavating a tunnel, the tunnel walls and ceiling may have to be supported by various anchorings, bolts and by injecting concrete or another filler into boreholes. It is also known to support the walls and ceiling of a tunnel already before starting the actual tunnel excavation. In that case, casing drilling may be employed where several boreholes are drilled next to one another according to the profile to be formed for the tunnel afterwards. In casing drilling, a casing is introduced into a borehole during drilling, where it may be left to support the poor-quality rock. In casing drilling, double equipment is used, i.e. drilling is performed by rotating a drill rod or a corresponding inner rod and by possibly rotating a casing around it or a corresponding outer tube by the drill's rotation device. The outermost end of the casing is provided with a ring bit and the outermost end of the drill rod with an inner bit. When the drilled borehole is sufficiently deep, the drill rod and the inner bit are withdrawn from the borehole. The casing can be left in the borehole, in which case it forms an element supporting the borehole. Furthermore, concrete, another soldering material and necessary supporting members may be fed into the casing.

When long boreholes are drilled, casing drilling is performed as extension drill equipment drilling. In that case, the drilling components employed in casing drilling, i.e. drill rods and casings are connected one after the other in the longitudinal direction. Both the drill rods and the casings may be provided with joining threads for connecting. When the drilling equipment is extended, it has to be possible to turn both the drill rods and the casings about their longitudinal axis so that the joining threads of successive drilling components can be connected together. Correspondingly, when the drilling equipment is disassembled, it has to be possible to turn the drilling components about their longitudinal axis to disconnect the joining threads. However, the connecting of drill rods and casings must be performed non-simultaneously, in which case it has to be possible to turn the drill rod and casing to be connected regardless of each other. Prior art drilling units employed in casing drilling are provided with a separate turning unit for turning the casing regardless of the drill rod when casings are being connected to or disconnected from each other. Such a turning unit, however, disadvantageously increases the weight of the drilling unit and causes extra costs and additional need for maintenance.

BRIEF DESCRIPTION OF THE INVENTION

The object of the invention is to provide a new and improved method and devices for casing drilling.

The method according to the invention is characterized by using the adapter device comprising an inner piece to be connected to the inner rod and an outer piece to be connected to the outer casing in the joining and disassembly of the extension drill equipment; supplying rotation force to the inner piece of the adapter device and transmitting it from the inner piece to the outer piece; and moving the outer piece in the axial direction with respect to the inner piece to select whether the rotation force generated by the rotation device affects the inner rod or the outer tube.

The drilling unit according to the invention is characterized in that the inner piece is connected to the outer piece by at least one connecting means, the connecting means being arranged to transmit rotation force between the inner piece and the outer piece regardless of the mutual longitudinal position of the pieces; and the adapter device comprises at least one actuator for moving the outer piece in the longitudinal direction with respect to the inner piece, the mutual position between the second end of the inner piece and the second end of the outer piece being changeable in the longitudinal direction.

The adapter device according to the invention is characterized in that the inner piece is connected to the outer piece by at least one connecting means; the connecting means is arranged to transmit rotation force between the inner piece and the outer piece regardless of the mutual longitudinal position of the pieces; and the adapter device comprises at least one actuator for moving the outer piece in the longitudinal direction with respect to the inner piece, the mutual position between the second end of the inner piece and the second end of the outer piece being changeable in the longitudinal direction.

The idea underlying the invention is that in joining and disassembling drill components of casing drilling, i.e. in threading, a necessary rotation motion is generated both for the inner rods and the outer tubes by a rotation device included in the rock drilling machine. The adapter device is arranged to transmit the rotation force generated by the rotation device to the drilling components. Furthermore, the adapter device comprises means enabling transmission of the rotation force either to the inner rod or to the outer tube irrespective of each other during threading. The adapter device comprises an inner piece and an outer piece arranged around it. Rotation force can be supplied to the portion of the first end in the inner piece from the rotation device of the rock drilling device. The outermost end of the inner piece, i.e. the second end, is provided with rotatable joining means, typically joining threads, for connecting the inner piece to the inner rod. The outer piece is an elongated tube arranged around the inner piece. The outermost end of the outer tube, i.e. the second end, is provided with threadable joining means, typically with joining threads, for connecting the outer piece to the outer tube. Between the outer piece and the inner piece, there is one or more connecting means enabling transmission of rotation force from the inner piece to the outer piece. The connecting means thus always comprises at least a first counter-surface in the inner piece and at least a second counter-surface in the outer piece. Furthermore, the outer piece is arranged to be movable with respect to the inner piece in the longitudinal direction, in which case the outer piece can be moved by one or more actuators so as to move the joining means at the outermost end of the outer piece more outwards than the joining means at the outermost end of the inner piece.

An advantage of the invention is that the standard rotation device of a rock drilling machine can be utilized in handling the drilling equipment and thus no separate turning unit for turning the outer tube is no longer needed. Consequently, the structure of the drilling unit may be simpler, lighter and more compact than previously. Furthermore, since the adapter device is arranged on the rotation shaft of the rock drilling machine, it is well centred with respect to the drilling equipment to be joined and disassembled. In addition, the rotation force that can be generated by the rotation device of the rock drilling machine is clearly greater than the one generated by separate turning units. Thus also stuck joints can be opened with ease by the solution according to the invention. An advantage of the adapter device is its simple and reliable structure, for instance. By moving the outer piece of the adapter device between its front and rear positions, it is possible to select on threading whether the rotation force is directed from the adapter device to the inner rod or to the outer tube.

The basic idea of an embodiment according to the invention is that the inner piece is part of the rock drilling machine. In that case, the first end, i.e. the inner end, of the inner piece is provided with transmission means, such as toothing or the like, enabling receiving the rotation force from the rotation device.

The basic idea of an embodiment according to the invention is that the inner piece is a separate piece connectable to the drill shank of a rock drilling machine or to a corresponding rotation element by a bolt joint or the like. In that case, the adapter device does not necessitate any essential changes to the basic construction of the rock drilling machine.

The basic idea of an embodiment according to an embodiment of the invention is that rotation force is arranged to be transmitted by means of one or more splines and correspondingly by means of one or more elongated key grooves from the inner piece to the outer piece. The key groove may be formed on the outer surface of the inner piece and the spline may be attached to the inner surface of the outer piece, or alternatively the spline and the key groove are arranged vice versa. The arrangement formed by the spline and the key groove is able to transmit rotation forces but allows the spline to move in the axial direction in the elongated key groove. The key groove may substantially be an axial groove. In some cases, the key groove may be slightly oblique with respect to the axial direction, or the key groove may be a sparsely helical line. The connecting means based on the spline and key groove are relatively simple to form, inexpensive and have a durable structure.

The basic idea of an embodiment according to the invention is that the cross section of the outer surface of the inner piece in the adapter device and the cross section of the inner surface of the outer piece are shaped so that shape locking is formed between the above-mentioned pieces with respect to the rotation force about the longitudinal axis. However, the cross-sectional shapes of the surfaces allow the inner piece and the outer piece to move in the direction of the longitudinal axis. In practice, the counter-surfaces may be shaped so that they have a non-circular cross section, such as an elliptical or an angular cross section. In this case, the counter-surfaces between the inner and the outer piece form the connecting means.

The basic idea of an embodiment according to the invention is that the adapter device comprises two or more actuators, such as pressure medium-operated cylinders or the like, which are arranged to move the outer piece with respect to the inner piece by means of a transfer piece. The transfer piece is an elongated piece arranged transversely to the outer piece and attached to the outer piece so as to allow it to transmit axial transfer forces. Rotation forces, on the other hand, are not transmitted between the outer piece and the transfer piece but the transfer piece may be mounted in the outer piece by bearings, for instance.

The basic idea of an embodiment according to the invention is that the outer piece of the adapter device can be locked into the inner piece in the axial direction in at least one position of the outer piece. The locking may take place in the extreme position of the spline and the key groove or the locking may be based on bayonet locking, screw locking or another appropriate locking mechanism. When the outer piece is in this locked position, the axial force directed to the inner piece may be transmitted to the outer piece. In that case, the feed mechanism included in the drilling unit may generate a back-acting force in the rock drilling machine which is transmitted to the outer tube through the adapter device. This feature may be utilized in a special application of casing drilling where outer tubes are removed from the borehole after drilling, or after drilling and feeding of other supporting means. An advantage is that no separate withdrawal elements are needed to withdraw the outer tubes but the standard feeding mechanism of the drilling unit can be utilized. Furthermore, the feeding mechanism provides a sufficient force for withdrawing the outer tubes from the borehole.

The basic idea of an embodiment according to the invention is that the outer tube is withdrawn from the borehole by an actuator included in the adapter device. In that case, the actuator generates the force required in withdrawal. A further alternative is that the actuator of the adapter device transmits the force required in withdrawal from the feeding mechanism to the outer tube.

The basic idea of an embodiment according to the invention is that the rock drilling device comprises a percussion device for providing impact pulses for the inner rod. The impact pulses can also be transmitted from the inner bit to the ring bit.

BRIEF DESCRIPTION OF THE FIGURES

Embodiments of the invention will be described in greater detail in the accompanying drawings, in which.

For the sake of clarity, the figures illustrate some embodiments of the invention in a simplified manner. Like reference numbers refer to like parts in the figures.

DETAILED DESCRIPTION OF SOME EMBODIMENTS OF THE INVENTION

Figure 1:
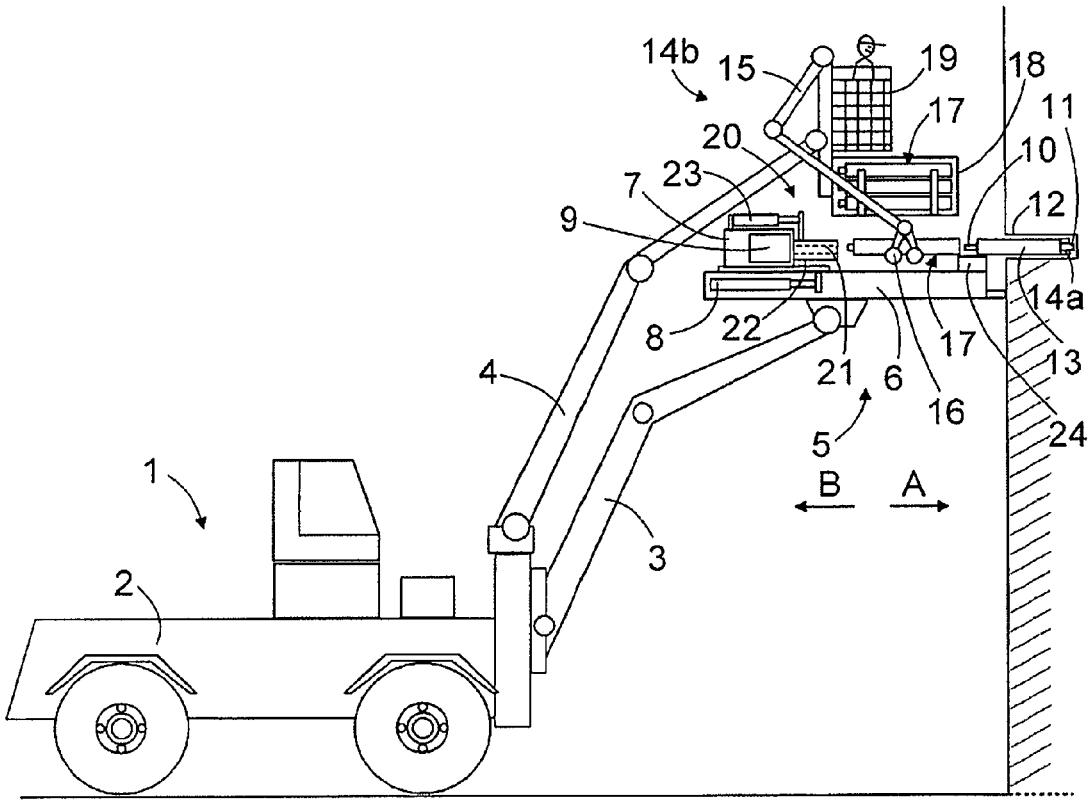
FIG. 1 is a schematic side view of a drill rig provided with a drilling unit according to the invention.

FIG. 1 illustrates a drill rig 1 provided with equipment for casing drilling. The carrier 2 of the drill rig 1 may be provided with one or more drill booms 3 and one or more auxiliary booms 4. At the outermost end of the drill boom 3, there is a drilling unit 5, which may comprise a feed beam 6, a rock drilling machine 7 and a feeding mechanism 8 on the feed beam 6 for moving the rock drilling machine 7 forwards in direction A and backwards in direction B. The rock drilling machine 7 may comprise a rotation device 9 for rotating the drilling components used in drilling about their longitudinal axis. In some cases, the rock drilling machine 7 may also comprise a percussion device for providing impact pulses for drilling components for breaking rock. In casing drilling, double equipment is used. The rotation device 9 of the rock drilling machine 7 rotates an inner rod 10, whose outermost end is provided with an inner bit 11, which is forming a borehole 12. The inner bit 11 is further arranged to pull with it an outer tube 13 into the borehole 12. The outer tube 13 may be rotated in the borehole 12 by means of the inner bit 11, for instance. The outer tube 13 is arranged around the inner rod 10. The outermost end of the outer tube 13 is provided with a ring bit 14*a*, which reams the borehole 12 formed by the inner bit 11.

In the drilling of long boreholes 12, extension drill equipment drilling is employed where two or more drilling components are arranged one after another in the longitudinal direction. Since double equipment is used in casing drilling, it is necessary to be able to handle both inner rods 10 and outer tubes 13 in extension drill equipment drilling. For this purpose, the auxiliary boom 4 of the drill rig 1 may be provided with a manipulator 14*b*, which may include a boom 15 and gripping members 16 for transferring one set 17 of extension drill equipment at a time from an equipment magazine 18 provided in the auxiliary boom 4 to the drilling unit 5. The set 17 of extension drill equipment may comprise one outer tube 13 and one inner rod 10 already arranged inside it, in which case the drilling components can be moved simultaneously. The manipulator 14*b* may be a manual device which may be controlled by an operator. The auxiliary boom 4 may be provided with a cage 19 for the operator. Alternatively, the manipulator 14*b* and equipment magazine 18 may be automatic devices whose operation is controlled by one or more control units.

The drilling unit 5 may further comprise an adapter device 20, which may be arranged between the rock drilling machine 7 and the drilling equipment. The adapter device 20 may include an inner piece 21, to which rotation force may be transmitted from the rotation device 9 of the rock drilling machine 7. The adapter device 20 further comprises an outer piece 22, which is a tubular piece arranged around the inner piece 21. The rotation force may be transmitted from the inner piece 21 to the outer piece 22. In addition, the adapter device 20 may comprise one or more actuators 23 for moving the outer piece 22 in the axial direction. The actuator 23 may be, for example, a pressure medium-operated cylinder whose first end is connected to the rock drilling machine 7 or a carriage and whose second end may be connected to the rear portion of the outer piece 22 by suitable transmission means. The construction and operation of the adapter device 20 will be described in greater detail in connection with the following figures.

It further appears from FIG. 1 that the front end of the feed beam 6 may be provided with one or more holding devices 24 for locking at least one drill component immovable. In that case, the holding device 24 can be utilized in threading at least when the components of casing drilling are disconnected from each other. The holding device 24 may comprise at least one pair of holding jaws or similar locking members.

Casing drilling may also be applied in drilling holes for test and research purposes. In that case, the outer tube may support the borehole and protect the measuring devices to be arranged in the borehole.

Figure 2:
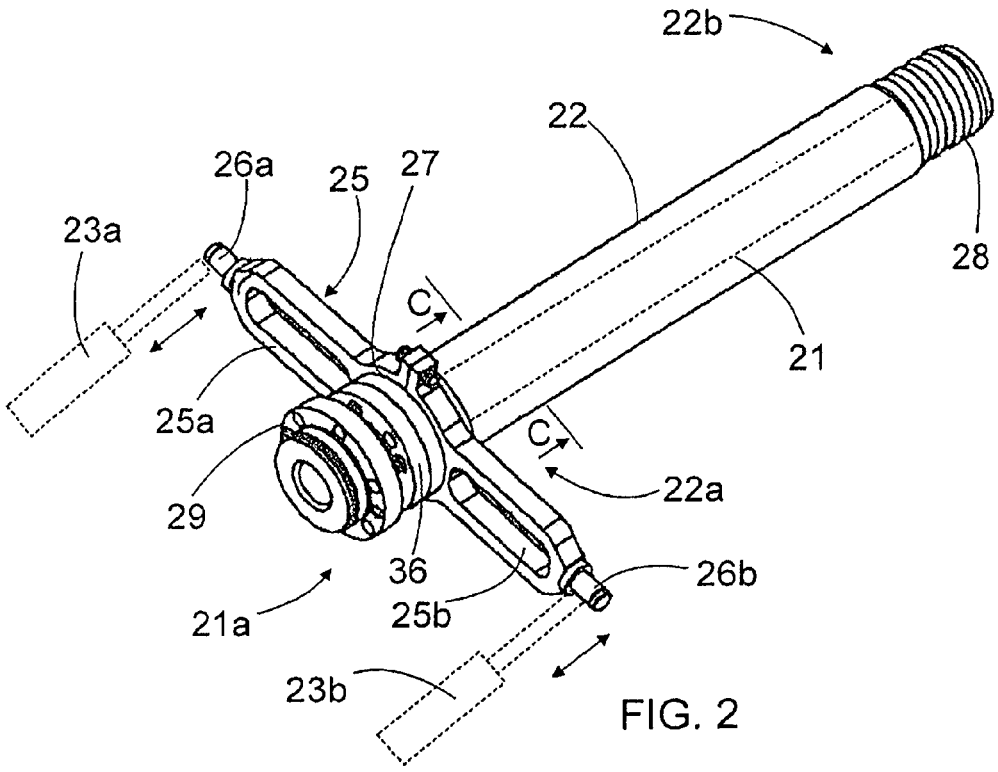
FIG. 2 is a schematic perspective view of an adapter device according to the invention.
Figure 3:
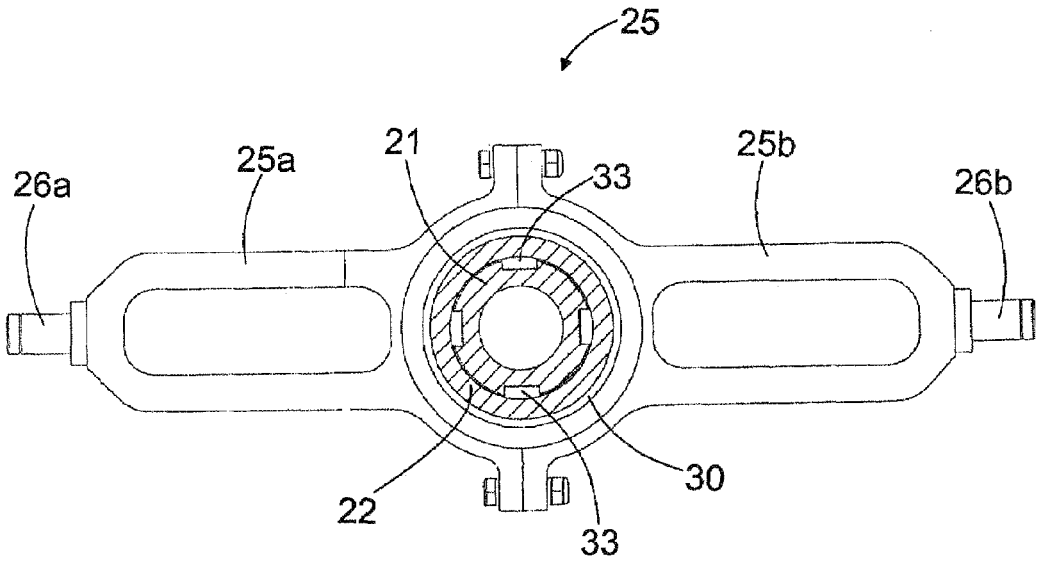
FIG. 3 is a schematic view of a transfer piece, inner piece and outer piece included in an adapter device according to the invention.
Figure 6:
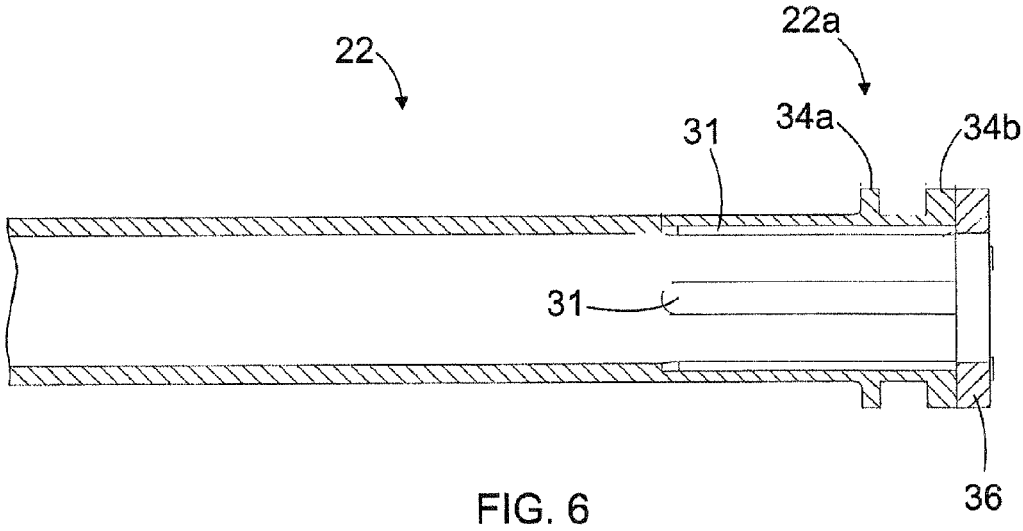
FIG. 6 is a schematic and cross-sectional side view of an outer piece.

The adapter device 20 illustrated in FIG. 2 includes two actuators, i.e. a first actuator 23*a* and a second actuator 23*b*, which are illustrated in a very simplified manner in the figure. A transfer piece 25, which may be an elongated piece, may be arranged in the portion of the first end of the outer piece 22. The ends of the transfer piece 25 may be provided with attachment points 26*a* and 26*b* to which the actuators 23*a* and 23*b* can be attached. The middle portion of the transfer piece 25 may be provided with a connection opening 27 together with bearing members so that rotation forces are not transmitted from the outer piece 22 to the transfer piece 25. Alternatively, the connection opening 27 is dimensioned so that it is not in contact with the outer surface of the outer piece 22 but there is a gap 30 between the connection opening 27 and the outer piece 22, as shown in FIG. 3. The transfer piece 25 is, however, connected to the outer piece 22 to enable transmission of the transmission force generated by the actuators 23*a*, 23*b* to the outer piece 22. One alternative is to arrange the transfer piece 25 between two flanges 34*a*, 34*b*, which may be provided in the portion of the first end 22*a* of the outer piece 22 as illustrated in FIG. 6. Furthermore, the transfer piece 25 may be formed of two parts 25*a*, 25*b* joined together, as appears from FIGS. 2 and 3.

It further appears from FIG. 2 that the second end 22*b* of the outer piece 22 may be provided with an external joining thread 28 enabling attachment of the outer piece to the outer tube 13 used in casing drilling. In FIG. 2, the inner piece 21 inside the outer piece 22 is illustrated with a broken line. The first end 21*a* of the inner piece 21 may comprise a fastening flange 29 or the like for attaching the inner piece 21 to the drill shank of the rock drilling machine 7 or to a similar rotation member. The second end of the inner piece 21 may comprise inner joining threads for attaching the inner piece 21 to the inner rod 10 used in casing drilling. It should be noted that the inner rod 10 may be made of solid material, it may comprise one or more elongated channels or it may have a clearly tubular cross section.

Figure 4:
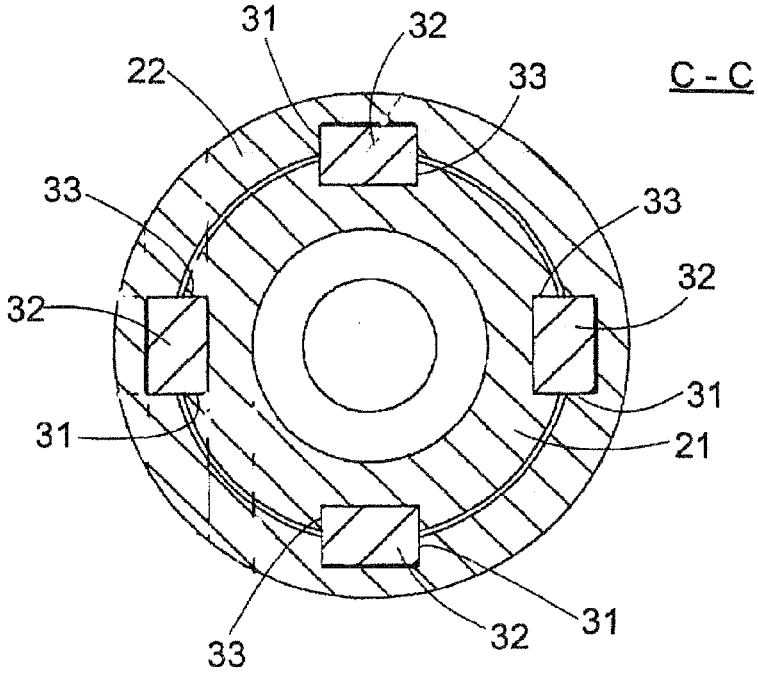
FIG. 4 is a schematic cross-sectional view along line C-C of an inner and an outer piece included in an adapter device according to the invention and of a connecting means between them.

FIG. 4 illustrates a cross section of the adapter device along line C-C. In the portion of the first end 22*a* of the outer piece, the inner surface of the outer piece 22 may be provided with one or more recesses 31, where one or more splines 32 may be arranged. The splines 32 may be attached to the recesses 31 by means of an adhesive, by a screw, by welding or by another appropriate manner. Furthermore, the outer surface of the inner piece 21 may comprise one or more key grooves 33, which may extend from the portion of the first end 21*a* of the inner piece 21 to the portion of its second end 21*b*. The position and dimensions of the key grooves 33 are arranged to correspond to the splines 32. The number of splines 32 and key grooves 33 may be selected according to the magnitude of the rotation force to be transmitted, for example, but in most cases four splines 32 and four key grooves 33 are sufficient.

Figure 5:
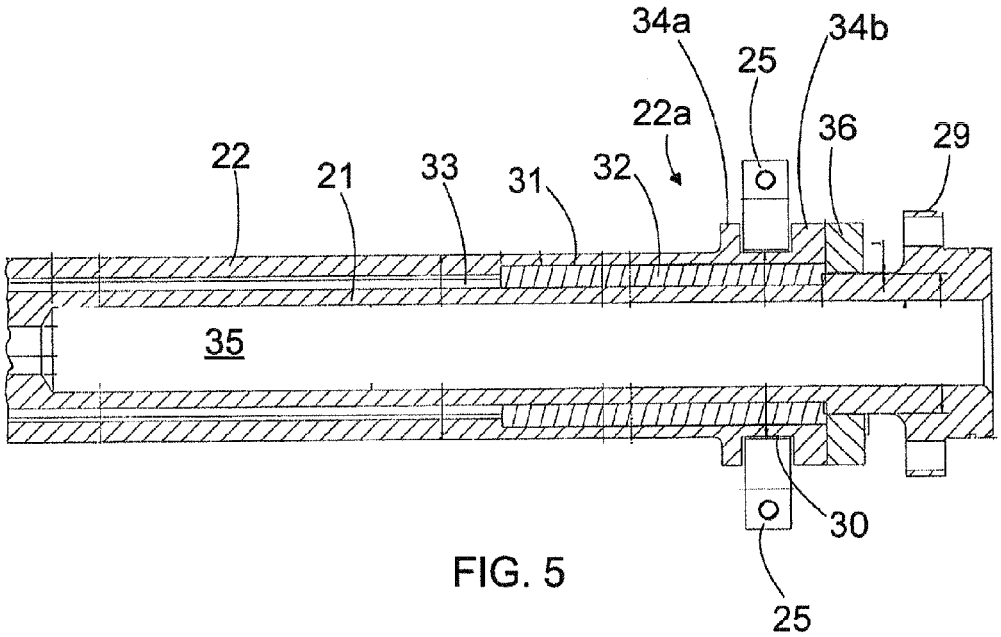
FIG. 5 is a schematic and cross-sectional side view of an inner piece, outer piece, connecting means and transfer piece included in an adapter device according to the invention.

FIG. 5 is a cross-sectional view of a part of the inner piece 21 and the outer piece 22 included in the adapter device and of the connecting members between them. In this case, the connecting members include splines 32, which are attached to the outer piece 22. The inner piece 21 is provided with elongated key grooves 33. The first end 22*a* of the outer piece 22 may further comprise flanges 34*a* and 34*b*, between which a transfer piece 25 may be arranged. The first end 22*a* of the outer piece may further comprise a cover 36, which may prevent the splines from moving axially with respect to the recess 31. As further appears from FIG. 5, the inner piece 21 may be a tubular piece or provided with one or more channels 35 for supplying flushing medium to the drill bit.

FIG. 6 is a cross-sectional view of a part of the outer piece 22. As appears from the figure, the first end 22*a* of the outer piece may be provided with recesses 31, where the splines 32 may be arranged. On the other hand, the splines 32 can also be arranged at the second end 22*b* of the outer piece 22. Furthermore, the spline 32 may be substantially as long as the outer piece 22. In addition, the spline 32 and the key groove 33 may be arranged with respect to the inner piece 21 and the outer piece 22 contrary to what was stated above.

Figure 7:
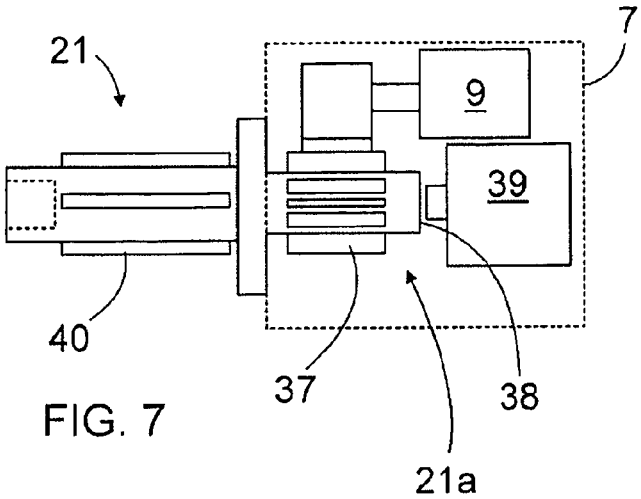
FIG. 7 is a schematic view of a rock drilling machine.

FIG. 7 is a highly simplified illustration of a rock drilling machine 7 where the inner piece 21 is part of the drill structure. The first end 21*a* of the inner piece 21 is provided with transmission members 37, such as toothing, for transmitting rotation force from the rotation device 9 to the inner piece 21. Furthermore, the first end 21*a* of the inner piece 21 may comprise an impact surface 38 for receiving impact pulses from a percussion device 39 included in the rock drilling machine 7. The inner piece 21 illustrated in FIG. 7*a* may be made of solid material and its outer circumference may be provided with one or more projections 40, which may function as connecting means between the inner piece 21 and the outer piece 22.

Figure 8:
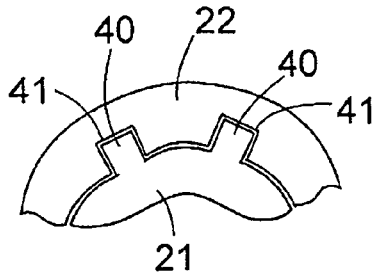
FIG. 8 is a schematic and cross-sectional view of a part of connecting means of an adapter device according to the invention.

FIG. 8 illustrates part of the cross sections of the inner piece 21 and the outer piece 22. As appears from the figure, the inner surface of the outer piece 22 may comprise one or more grooves 41 where the projections 40 of the inner piece 21 are arranged. The projections 40 and the grooves 41 may be shaped and dimensioned in an appropriate manner and their number can be selected according to the need.

Figure 9:
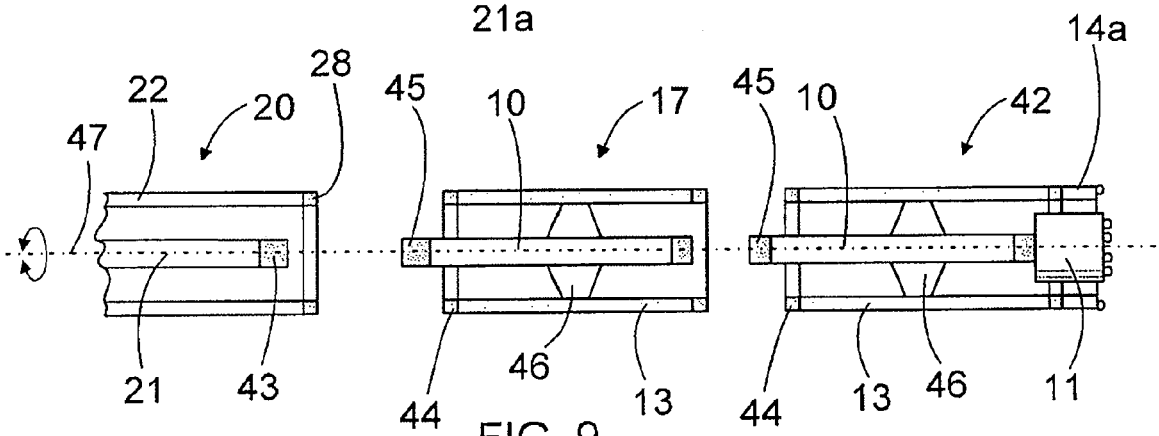
FIGS. 9 and 10 are schematic side views of the operation of an adapter device according to the invention.
Figure 10:
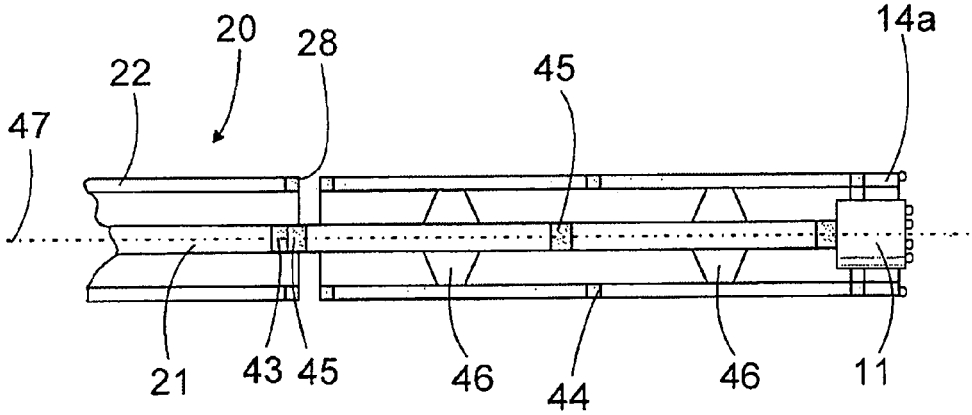

FIGS. 9 and 10 illustrate the operation of the adapter device in casing drilling. When the extension drill equipment is extended, a set 17 of extension drill equipment is arranged between the rock drilling machine 7 and the drilling equipment 42 already in the borehole 12. After this, the outer piece 22 belonging to the adapter device 20 is driven to its frontmost position, in which case the joining members 28 at the outermost end of the outer piece 22 extend further than the joining members 43 in the inner piece 21, as can be seen from FIG. 9. After this, the feeding device 8 moves the rock drilling machine 7 towards the set 17 of extension drill equipment and the joining members 28 of the outer piece 22 are connected to the joining members 44 in the outer tube 13. The outer tube 13 is then connected to the outer tube already in the borehole 12 by means of the rotation device 9. After this, the outer piece 22 is pulled into its rear position illustrated in FIG. 10 and the joining members 45 of the inner rod 10 are connected using the rotation device 9. In some cases, the inner equipment may be connected first and then the outer equipment. The holding device 24 illustrated in FIG. 1 may be used to assist during connecting and disconnecting. FIGS. 9 and 10 further illustrate supporting means 46 for centring the inner rod 10 against the inner surface of the outer tube 13 parallel with the drilling axis 47.

Figure 11:
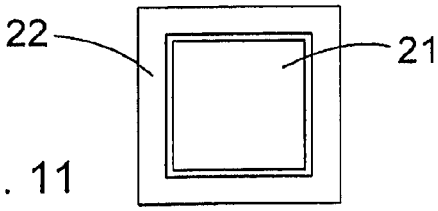
FIG. 11 is a schematic and cross-sectional view of a feasible shaping of the inner and the outer piece.

The cross section illustrated in FIG. 11 shows that the cross sections of the inner piece 21 and the outer piece 22 may also be shaped so that they can transmit rotation forces about their longitudinal axis but at the same time allow movement in the axial direction with respect to each other. In this case, the outer surface of the inner piece 21 and the inner surface of the outer piece form a pair of connecting means for transmitting rotation force.

It should be noted that the in this application, the term 'rock' refers to rock, soft rock material and any other crust material.

The features illustrated in this application may also be combined to form desired combinations. In some cases, the illustrated features may even be used as such regardless of the other features.

The drawings and the related description are only intended to illustrate the inventive concept. The details of the invention may vary within the scope of the claims.

What is claimed is:

1. A method for casing drilling, the method comprising:

drilling rock by rotating an inner rod (10) by a rotation device (9) included in a rock drilling machine (7), and breaking rock by at least one drill bit (11, 14) and pulling an outer tube (13) into a borehole (12) during drilling;

forming extension drill equipment by joining two or more inner rods (10) one after another in the longitudinal direction and by correspondingly joining two or more outer tubes (13) one after another in the longitudinal direction;

turning the inner rod (10) about its longitudinal axis when the inner rods (10) are joined together or when the extension drill equipment is disassembled;

turning the outer tube (13) about its longitudinal axis when the outer tubes (13) are joined together or when the extension drill equipment is disassembled;

performing the turning needed to join the inner rods (10) and the outer tubes (13) non-simultaneously;

turning the inner rod (10) and the outer tube (13) by means of the rotation device (9) of the rock drilling machine (7) and an adapter device (20) connected thereto when the extension drill equipment is being assembled or disassembled, characterized by using the adapter device (20) comprising an inner piece (21) to be connected to the inner rod (10) and an outer piece (22) to be connected to the outer casing (13) in the joining and disassembly of the extension drill equipment;

supplying rotation force to the inner piece (21) of the adapter device (20) and transmitting it from the inner piece (21) to the outer piece (22); and moving the outer piece (22) in the axial direction with respect to the inner piece (21) to select whether the rotation force generated by the rotation device affects the inner rod (10) or the outer tube (13).

2. A method according to claim 1, characterized by withdrawing the outer tube (13) from the borehole (12) after drilling; and using a feeding mechanism (8) included in the drilling unit for withdrawing the outer tube (13).

3. A drilling unit comprising:

a rock drilling machine (7) including at least one rotation device (9) for rotating at least one inner rod (10) about its longitudinal axis;

a feed mechanism (8) for moving the rock drilling machine (7); and a feed beam (6) which supports the rock drilling machine (7) and on which the rock drilling machine is moved forward towards the rock to be drilled and backwards;

an adapter device (20) arranged to transmit the rotation force generated by the rotation device (9) of the rock drilling machine (7) to the inner rod (10);

the adapter device (20) comprising an elongated inner piece (21) whose first end (21*a*) receives the rotation force generated by the rotation device (9) and whose second end (21*b*) is connectable to the inner rod (10);

the adapter device (20) further comprising an outer piece (22), which is an elongated tubular piece, which is arranged at least partly around the inner piece (21) and whose second end (22*b*) is connectable to the outer tube (13) used in casing drilling, characterized in that the inner piece (21) is connected to the outer piece (22) by at least one connecting means (32, 33; 40, 41), the connecting means being arranged to transmit rotation force between the inner piece (21) and the outer piece (22) regardless of the mutual longitudinal position of the pieces; and the adapter device (20) comprises at least one actuator (23) for moving the outer piece (22) in the longitudinal direction with respect to the inner piece (21), the mutual position between the second end (21*b*) of the inner piece and the second end (22*b*) of the outer piece being changeable in the longitudinal direction.

4. A drilling unit according to claim 3, characterized in that the inner piece (21) is a separate piece connected to a rotation member rotated by the rotation device (9) of the rock drilling machine (7).

5. A drilling unit according to claim 3, characterized in that the inner piece (21) is part of the rock drilling machine (7); and the inner piece (21) comprises rotation members (37) for receiving the rotation force from the rotation device (9).

6. A drilling unit according to any one of preceding claims 3 to 5, characterized in that the rock drilling machine (7) comprises at least one percussion device (39) for generating impact pulses for the inner rod (10).

7. A drilling unit according to any one of preceding claims 3 to 6, characterized in that the front end portion of the feed beam (6) comprises at least one holding device (24); and the holding device (24) is arranged to lock at least one drilling component immovable at least when the connections between the components used in casing drilling are disconnected.

8. An adapter device for transmitting rotation force from a rotation device (9) of a rock drilling machine (7) to at least one tool, the adapter device (20) comprising:

an elongated inner piece (21) having a first end (22*a*) and a second end (21*b*);

the first end (21*a*) of the inner piece comprising first means enabling transmission of rotation force from the rotation device (9) of the rock drilling machine (7) to the inner piece (21) and the second end (21*b*) of the inner piece comprising second joining means (43) enabling connecting the inner piece (21) to the inner rod (10);

an outer piece (22), which is an elongated tubular piece having a first end (22*a*) and a second end (22*b*) and which is arranged at least partly around the inner piece (21);

the second end (22*b*) of the outer piece comprising third joining means (28) enabling connecting the outer piece (22) to an outer tube (13) used in casing drilling, characterized in that the inner piece (21) is connected to the outer piece (22) by at least one connecting means (32, 33; 40, 41);

the connecting means is arranged to transmit rotation force between the inner piece (21) and the outer piece (22) regardless of the mutual longitudinal position of the pieces; and and the adapter device (20) comprises at least one actuator (23) for moving the outer piece (22) in the longitudinal direction with respect to the inner piece (21), the mutual position between the second end (21*b*) of the inner piece and the second end (22*b*) of the outer piece being changeable in the longitudinal direction.

9. An adapter device according to claim 8, characterized in that the connecting means comprises at least a first connecting means formed in the inner piece (21);

the connecting means comprises at least a second connecting means formed in the outer piece (22);

at least a first connecting means is an elongated key groove (33); and at least a second connecting means is a spline (32) arranged to slide in the key groove (33).

10. An adapter device according to claim 8, characterized in that the shape of the cross section of the outer surface in the inner piece (21) and the shape of the cross section of the inner surface in the outer piece (22) are arranged so as to provide shape locking between the inner piece (21) and the outer piece (22) with respect to the rotation about the longitudinal axis.

11. An adapter device according to claim 10, characterized in that the outer surface of the inner piece (21) is provided with several projections (40); and the inner surface of the outer piece (22) is provided with several longitudinal grooves (41) at the points corresponding to the projections (40).

12. An adapter device according to any one of preceding claims 8 to 11, characterized in that the adapter device (20) comprises a first actuator (23*a*) and a second actuator (23*b*);

the adapter device (20) comprises a transfer piece (25), which is arranged transversely to the outer piece (22);

the transfer piece (25) is an elongated piece whose opposite ends are provided with attachment points (26*a*, 26*b*) for attaching the first actuator (23*a*) and the second actuator (23*b*) to the transfer piece (25);

the middle portion between the ends of the transfer piece (25) is provided with a connection opening (27), through which the outer piece (22) is arranged;

the connection opening (27) is provided with means allowing rotation of the outer piece (22) substantially freely about its longitudinal axis; and the transfer piece (25) is arranged to transmit the axial forces generated by the actuators (23*a*, 23*b*) to the outer piece (22), whereby the outer piece (22) is movable in the axial direction.

* * * * *